US012791034B2

(12) United States Patent
Cao et al.

(10) Patent No.: US 12,791,034 B2
(45) Date of Patent: Nov. 10, 2026

(54) DIVERSION SYSTEM ASSEMBLY FOR MINIATURE FAN

(71) Applicant: Hunan Yichi Motor Co., Ltd., Yiyang (CN)

(72) Inventors: Tianyou Cao, Yiyang (CN); Changqing Gui, Shenzhen (CN)

(73) Assignee: Hunan Yichi Motor Co., Ltd., Yiyang (CN)

( * ) Notice: Subject to any disclaimer, the term of this patent is extended or adjusted under 35 U.S.C. 154(b) by 0 days.

(21) Appl. No.: 19/297,800

(22) Filed: Aug. 12, 2025

(65) Prior Publication Data

US 2025/0369447 A1 Dec. 4, 2025

(30) Foreign Application Priority Data

May 22, 2025 (CN) ..... 202521020265.8

(51) Int. Cl.

| | |
|---|---|
| ***F04D 19/00*** | (2006.01) |
| ***F04D 29/32*** | (2006.01) |
| ***F04D 29/38*** | (2006.01) |
| ***F04D 29/54*** | (2006.01) |

(52) U.S. Cl.

CPC ..... *F04D 19/002* (2013.01); *F04D 29/329* (2013.01); *F04D 29/384* (2013.01); *F04D 29/542* (2013.01)

(58) Field of Classification Search

CPC .... F04D 19/002; F04D 29/329; F04D 29/384; F04D 29/542; F05D 2260/961; F05D 2250/75

See application file for complete search history.

(56) References Cited

U.S. PATENT DOCUMENTS

| | | | | |
|---|---|---|---|---|
| 9,505,092 | B2 * | 11/2016 | Brownell | B23P 15/006 |
| 2009/0269195 | A1 * | 10/2009 | Hsu | F04D 25/0613 415/208.2 |
| 2010/0226769 | A1 | 9/2010 | Helps | |
| 2010/0226797 | A1 | 9/2010 | Fitton et al. | |
| 2010/0226801 | A1 | 9/2010 | Gammack | |
| 2014/0237819 | A1 * | 8/2014 | Brownell | B23P 15/006 29/889.6 |
| 2021/0262488 | A1 * | 8/2021 | Loercher | F04D 29/542 |

FOREIGN PATENT DOCUMENTS

| | | | | |
|---|---|---|---|---|
| CN | 114215775 A * | 3/2022 | | F04D 25/0693 |

* cited by examiner

*Primary Examiner* — Eldon T Brockman

(74) *Attorney, Agent, or Firm* — Hemisphere Law, PLLC

(57) ABSTRACT

Disclosed is a diversion system assembly for a miniature fan. The diversion system assembly for a miniature fan includes a cylinder and a blade wheel located at an end opening of the cylinder and connected to a rotor. A deflector is arranged inside the cylinder. Blades are arranged in an annular array around the blade wheel. The thickness of each blade is gradually increased from two ends to the middle, thus forming an arched part in the middle of the blade. Top ends of the blades gradually tilt forward from inside to outside, and bottom ends of the blades gradually tilt backward from inside to outside.

4 Claims, 7 Drawing Sheets

DIVERSION SYSTEM ASSEMBLY FOR MINIATURE FAN

BACKGROUND OF THE DISCLOSURE

Technical Field

The present disclosure relates to the technical field of fans and, in particular, to a diversion system assembly for a miniature fan.

Description of Related Art

As we all know, a fan is a machine that relies on an input mechanical energy to increase gas pressure and send gas out. The fan is a driven fluid machine and also a gas compression and gas transfer machine that converts a rotating mechanical energy into a gas pressure energy and a kinetic energy, and sends gas out. Fans are widely used in various places, as well as in household appliances in daily life, such as vacuum cleaners and hair dryers.

At present, when these fans are used in household appliances, the fans will be made small or miniature. However, in order to meet the demand for efficiency, the fans need to be structured as high-speed fans, that is, the rotation speed of the fans must be higher. For a fan, a diversion system assembly is made up of a housing, an air inlet, an air outlet, deflectors inside the housing, and a blade wheel connected to a rotor. The air blowing effect of the fan is determined by the performance of the diversion system assembly. The performance of the diversion system depends more on the blade wheel. The blade thickness of the conventional blade wheel is always inclined toward one direction (as shown in FIG. 1). When the blade wheel rotates at a high speed and the speed is high to a certain extent or the resistance is large to a certain extent, a vortex cyclone (as shown in FIG. 2) will be formed on a leeward surface of a blade because the blade is inclined, causing loud noise. The vortex cyclones will affect the airflow intake of the next blade, thus causing a reduction in the air volume.

SUMMARY OF THE DISCLOSURE

In view of the above shortcomings in the prior art, an objective of the present disclosure is to provide a diversion system assembly for a miniature fan.

In order to achieve the above objective, the present disclosure adopts the following technical solutions:

A diversion system assembly for a miniature fan includes a cylinder and a blade wheel located at an end opening of the cylinder and connected to a rotor. A deflector is arranged inside the cylinder. Blades are arranged in an annular array around the blade wheel. The thickness of each blade is gradually increased from two ends to the middle, thus forming an arched part in the middle of the blade. Top ends of the blades gradually tilt forward from inside to outside, and bottom ends of the blades gradually tilt backward from inside to outside.

Preferably, the blade wheel is conical.

Preferably, the number of blades is odd.

Preferably, the deflector is arc-shaped.

Based on the above solutions, the present disclosure designs the thicknesses of two ends of each blade to make the middle part thicker and the two ends thinner, forming an arched part in the middle of the blade to raise the place where a vortex cyclone is easy to form. Moreover, since the two ends of each blade are designed to gradually tilt forward and backward, the blade takes on an "S" shape to achieve a better air diversion effect, thereby reducing the probability of vortex formation, and further achieving noise reduction.

DETAILED DESCRIPTION OF THE EMBODIMENTS

Figure 1:
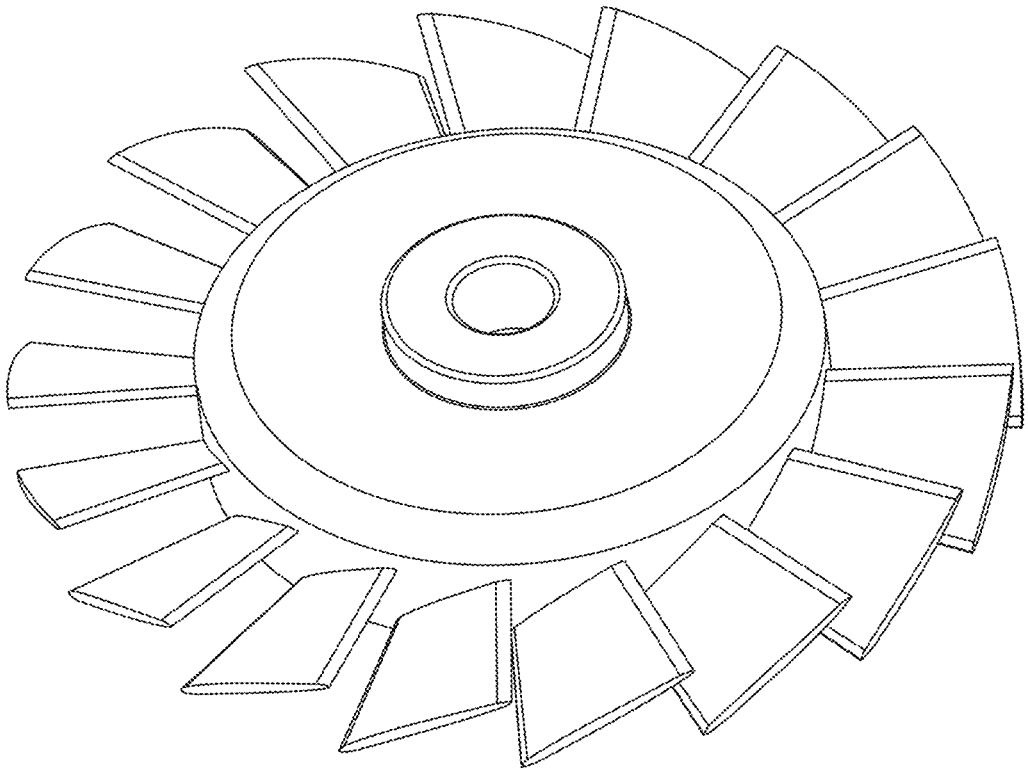
FIG. 1 (Prior Art)
FIG. 1 is a schematic structural diagram of a conventional blade wheel described in the background.
Figure 2:
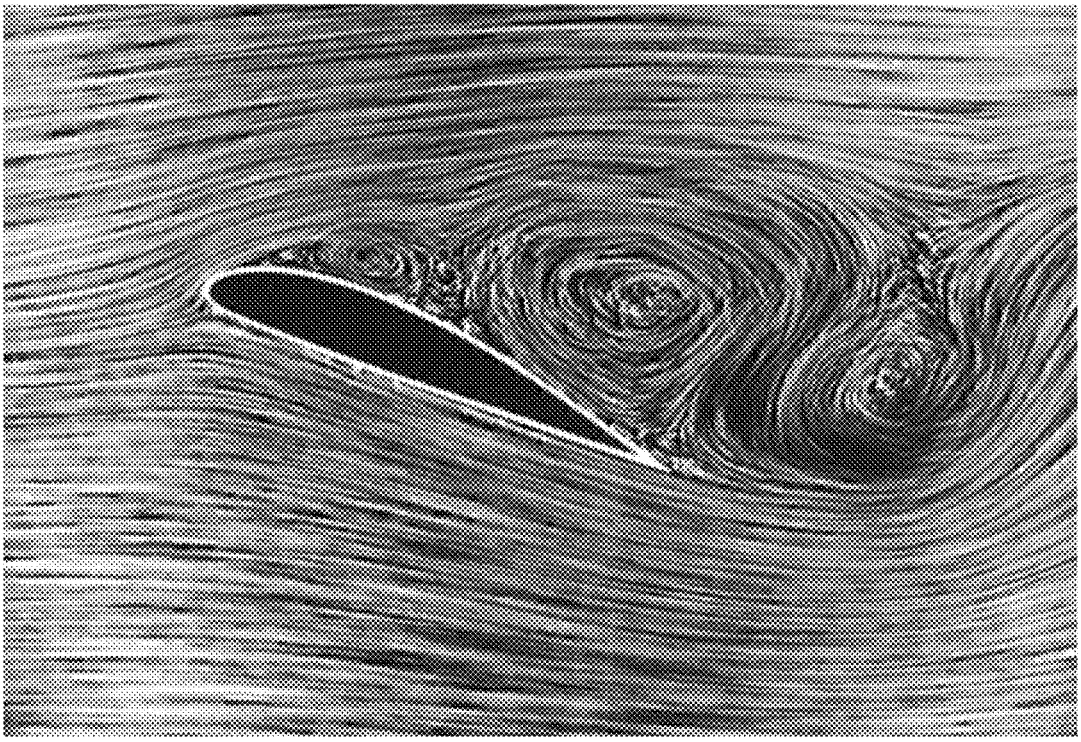
FIG. 2 is a schematic diagram of the principle of vortex generation described in the background.
Figure 3:
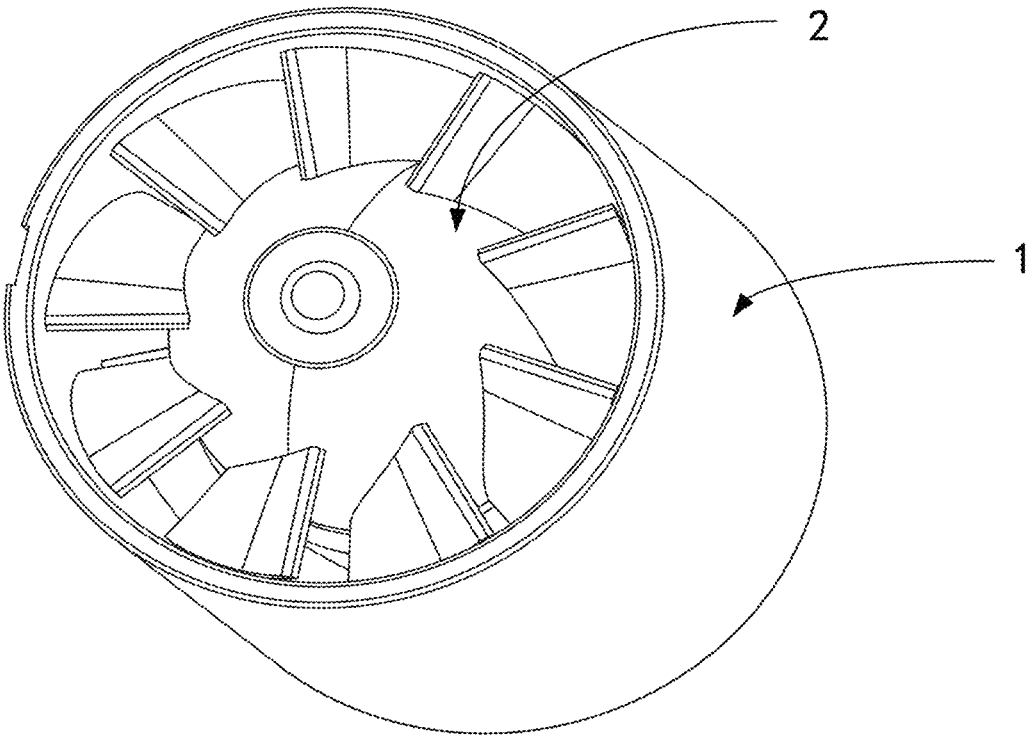
FIG. 3 is a schematic structural diagram of a diversion system assembly for a miniature fan in an embodiment of the present disclosure.
Figure 4:
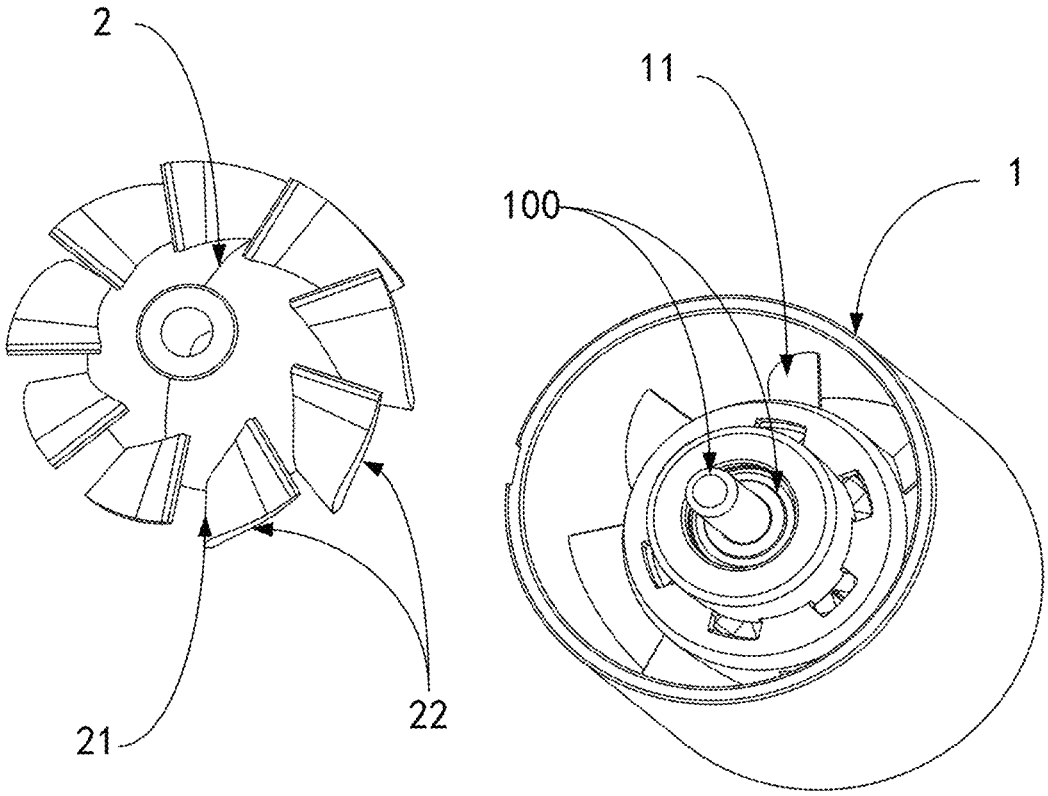
FIG. 4 is an exploded diagram of the diversion system assembly for a miniature fan in an embodiment of the present disclosure.
Figure 5:
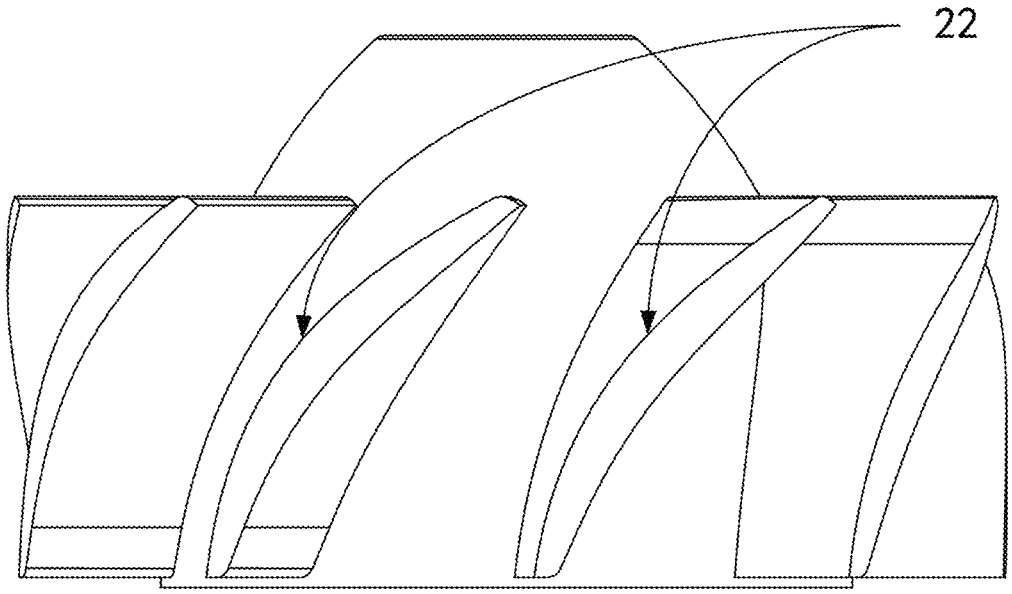
FIG. 5 is a schematic structural diagram of a blade wheel in an embodiment of the present disclosure.

In order to make the objective, technical solution and advantages of the present disclosure more clearly understood, the present disclosure is further described in detail in combination with the accompanying drawings and embodiments. It should be understood that the specific embodiments described herein are only intended to explain the present disclosure but not to define the present disclosure.

In the description of the present disclosure, it should be understood that the orientation or position relationships indicated by the terms "center", "longitudinal", "transverse", "length", "width", "thickness", "up", "down", "front", "back", "left", "right", "vertical", "horizontal", "top", "bottom", "inside", "outside", "clockwise", "counterclockwise", etc., are based on the orientation or position relationships shown in the accompanying drawings and are used only for the convenience of describing the present disclosure and simplifying the description, rather than indicating or implying that the device or element referred to must have a specific orientation, be constructed and operated in a specific orientation. Therefore, they should not be understood as limiting the present disclosure. In addition, the terms "first" and "second" are used for descriptive purposes only rather than being understood as indicating or implying relative importance or as implicitly indicating the quantity of technical features indicated. Therefore, the features defined as "first" and "second" may explicitly or implicitly include one or more of the features. As described herein, "a plurality of" means two or more, unless otherwise clearly and specifically defined.

In the description of the present disclosure, it should be noted that, unless otherwise expressly specified and limited, the terms such as "mounted", "connected to" and "connect" shall be understood broadly. For example, they may refer to fixed connection, detachable connection, or integrated connection. They may refer to mechanical connection or electrical connection. They may refer to direct connection or indirect connection by means of an intermediate medium. They may refer to internal connection between two elements or an interactive relationship between two elements. For those of ordinary skill in the art, the specific meanings of the above terms in the present disclosure can be understood according to specific situations.

As shown in FIGS. 3-7, a diversion system assembly for a miniature fan in this embodiment includes a cylinder 1 and a blade wheel 2 located at an end opening of the cylinder 1 and connected to a rotor 100. A deflector 11 is arranged inside the cylinder. Blades 21 are arranged in an annular array around the blade wheel 2, and the number of blades 21 is odd. The thickness of each blade 21 is gradually increased from two ends to the middle, thus forming an arched part in the middle of the blade 21. The thickness of the arched part 22 is 1.5 to 2 times the edge thickness of the blade 21. Top ends of the blades 21 gradually tilt forward from inside to outside, and bottom ends of the blades 21 gradually tilt backward from inside to outside.

In this embodiment, the thicknesses of two ends of each blade 21 are designed to make the middle part thicker and the two ends thinner, forming an arched part 22 in the middle of the blade 21 to raise the place where a vortex cyclone is easy to form. Moreover, since the two ends of each blade 21 are designed to gradually tilt forward and backward, the blade 21 achieves a better air diversion effect, thereby reducing the probability of vortex formation, and further achieving noise reduction.

Figure 6:
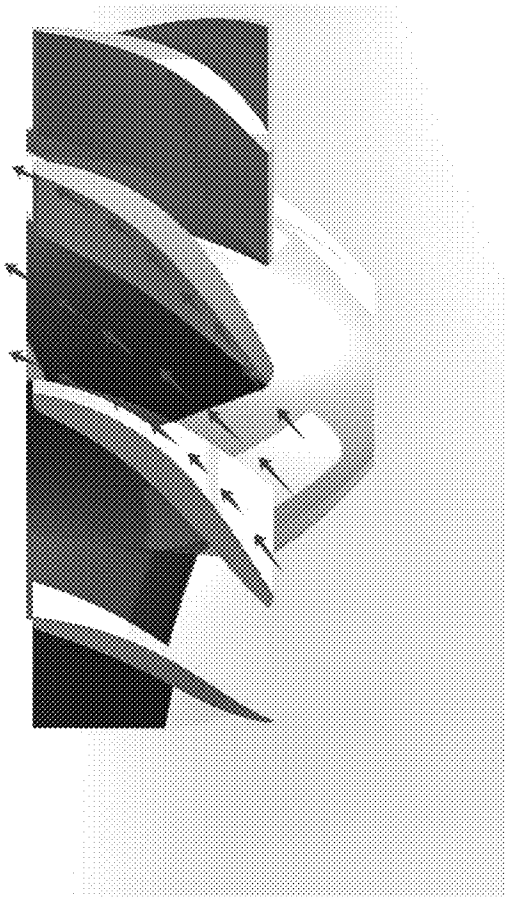
FIG. 6 is a schematic diagram of an airflow trend at the blade wheel in an embodiment of the present disclosure.

In order to better explain the principle of noise reduction, a specific explanation will be given in the form of suction. That is, in a case where the diversion system assembly for a miniature fan is used in a vacuum cleaner, as shown in FIG. 6, after the blade wheel 2 rotates, the airflow enters from the top end of the blade wheel 2 and is first guided by the inclined surfaces at the top ends of the blades 21. Then, after passing through the arched parts 22, the airflow will be deflected, allowing the airflow to be re-oriented at the position where vortices are prone to occur, thereby reducing the generation of vortices. At last, since the top end of each blade 21 is designed to gradually tilt forward from inside to outside and the bottom end of each blade 21 is designed to gradually tilt backward from inside to outside, so that the airflow is guided more smoothly.

Figure 7:
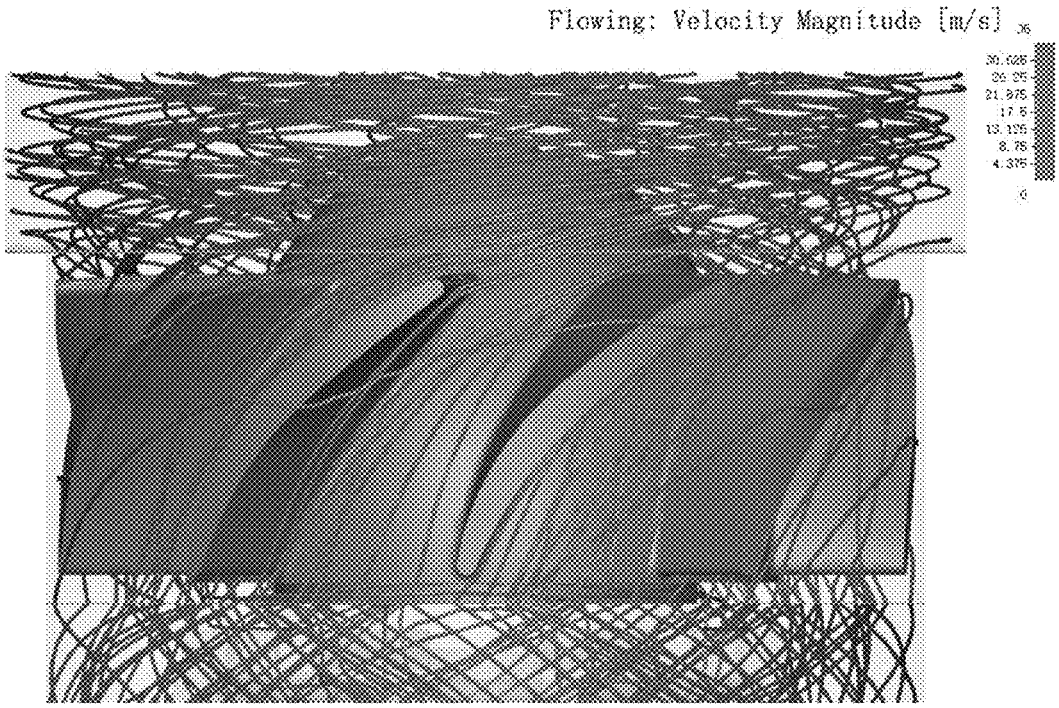
FIG. 7 is a schematic diagram of software-tested airflow trajectories in an embodiment of the present disclosure.

Moreover, in order to verify the feasibility, software testing was carried out on the airflow trend of the product. The test results are shown in FIG. 7. It can be seen that when entering the space between the blades 21, the airflow trajectories will become more orderly and less messy trajectories are produced, proving that the probability of vortex formation is effectively reduced.

Further, in order to better smoothen the entry of airflow, the blade wheel 2 is conical in this embodiment. The bullet-like design of the blade wheel 2 can reduce wind resistance, thus meeting the design requirements of high-speed rotation.

In addition, in this embodiment, the deflector 11 is arc-shaped. The arc-shaped design of the deflector 11 may be used to increase the wind pressure.

The above is only the preferred embodiment of the present disclosure, and does not therefore limit the scope of the patent of the present disclosure. All the equivalent structure or equivalent process transformations made by using the contents of the specification of the present disclosure and the accompanying drawings, or directly or indirectly applied in other related technical fields, are similarly included in the scope of patent of the present disclosure.

What is claimed is:

1. A diversion system assembly for a miniature fan, comprising a cylinder and a blade wheel located at an end opening of the cylinder and connected to a rotor, wherein a deflector is arranged inside the cylinder; the deflector being a stationary component independent of the blade wheel;

blades are arranged in an annular array around the blade wheel;

a thickness of each blade is gradually increased from a top end of the blade to a middle of the blade and from a bottom end of the blade to the middle of the blade, thus forming an arched part having a maximum thickness of 1.5 to 2 times a thickness at the top end and the bottom end;

the top end of the blade gradually tilts forward in a radially outward direction from a hub-side inner end toward a tip-side outer end; and the bottom end of each blade gradually tilts backward in the radially outward direction from the hub-side inner end toward the tip-side outer end, whereby each blade defines an S-shaped profile as viewed in a circumferential direction.

2. The diversion system assembly for a miniature fan according to claim 1, characterized in that: the blade wheel is conical.

3. The diversion system assembly for a miniature fan according to claim 2, characterized in that: the number of blades is odd.

4. The diversion system assembly for a miniature fan according to claim 3, characterized in that: the deflector is arc-shaped.

* * * * *